US009027454B2

(12) United States Patent
Wiesman et al.

(10) Patent No.: US 9,027,454 B2
(45) Date of Patent: May 12, 2015

(54) GROUND PRESSURE DETONATION DEVICE

(71) Applicant: QinetiQ North America, Inc., McLean, VA (US)

(72) Inventors: Richard Wiesman, Wayland, MA (US); Andrew Kirouac, Chelmsford, MA (US); David Meeker, Natick, MA (US); Joshua Berglund, Hopkinton, MA (US); Marco Jakob Tavernini, Windham, NH (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 13/660,382

(22) Filed: Oct. 25, 2012

(65) Prior Publication Data

US 2013/0104727 A1 May 2, 2013

Related U.S. Application Data

(60) Provisional application No. 61/628,258, filed on Oct. 27, 2011, provisional application No. 61/629,657, filed on Nov. 22, 2011.

(51) Int. Cl.
*F41H 11/12* (2011.01)
*F41H 11/30* (2011.01)
*F41H 11/18* (2011.01)

(52) U.S. Cl.
CPC ..... *F41H 11/12* (2013.01); *F41H 11/30* (2013.01); *F41H 11/18* (2013.01)

(58) Field of Classification Search
CPC ..... F41H 11/12; F41H 11/16; F41H 11/30; F41H 11/28; F41H 11/24; F41H 11/18; F41H 11/32; F41H 11/26; F41H 11/20; F41H 11/138; F41H 11/161; F41H 7/005
USPC ..... 89/1.13; 102/402, 403
See application file for complete search history.

(56) References Cited

U.S. PATENT DOCUMENTS

| | | | | |
|---|---|---|---|---|
| 619,426 | A * | 2/1899 | Mauger | 404/133.05 |
| 1,275,742 | A * | 8/1918 | Pritchard | 404/133.05 |
| 1,386,329 | A * | 8/1921 | Goldschmidt | 74/61 |
| 1,410,010 | A * | 3/1922 | Goldschmidt | 173/49 |
| 3,498,177 | A | 3/1970 | Moro | |
| 3,626,804 | A | 12/1971 | Paramythioti | |
| 3,866,693 | A * | 2/1975 | Century | 173/49 |
| 5,856,629 | A | 1/1999 | Grosch et al. | |
| 5,979,289 | A | 11/1999 | French | |
| 6,412,387 | B1 * | 7/2002 | French | 89/1.13 |
| 6,952,990 | B1 | 10/2005 | Clodfelter | |
| 8,424,437 | B2 * | 4/2013 | Grima | 89/1.13 |
| 2008/0134870 | A1 * | 6/2008 | Goldman et al. | 89/1.13 |
| 2008/0223636 | A1 | 9/2008 | Gutsche | |
| 2011/0067559 | A1 * | 3/2011 | Grima | 89/1.13 |
| 2012/0318643 | A1 * | 12/2012 | Hufford | 198/763 |

* cited by examiner

*Primary Examiner* — Bret Hayes
*Assistant Examiner* — Joshua Freeman
(74) *Attorney, Agent, or Firm* — Iandiorio Teska & Coleman, LLP

(57) ABSTRACT

A ground pressure detonation device includes a housing, a foot coupled to the housing, and an oscillation subsystem associated with the housing configured to oscillate the housing such that the foot impacts the ground with sufficient oscillating force to ensure detonation of one or more pressure sensitive explosive devices in and/or on the ground.

29 Claims, 9 Drawing Sheets

*FIG. 3*
PRIOR ART
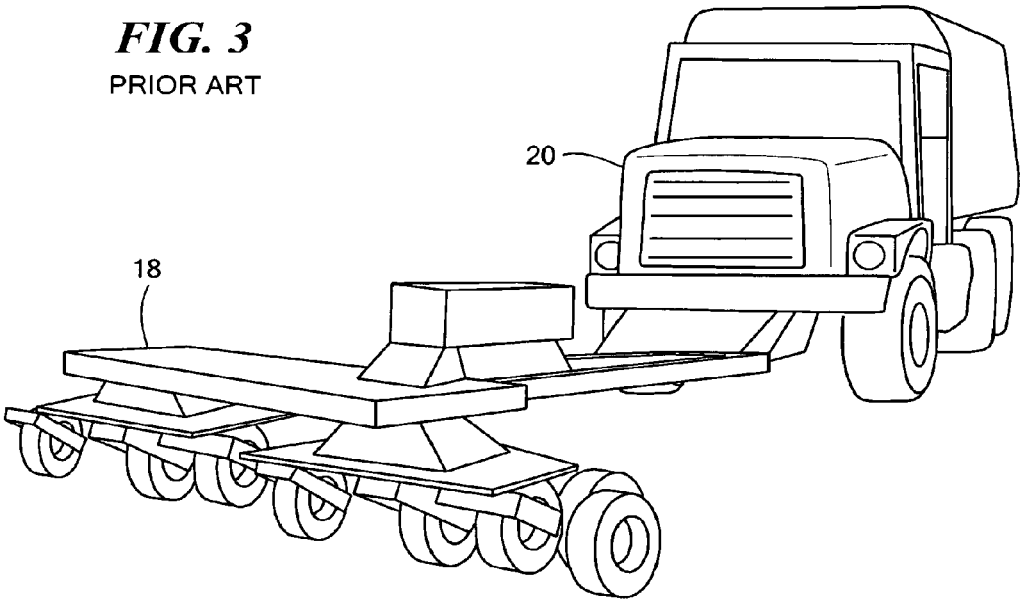
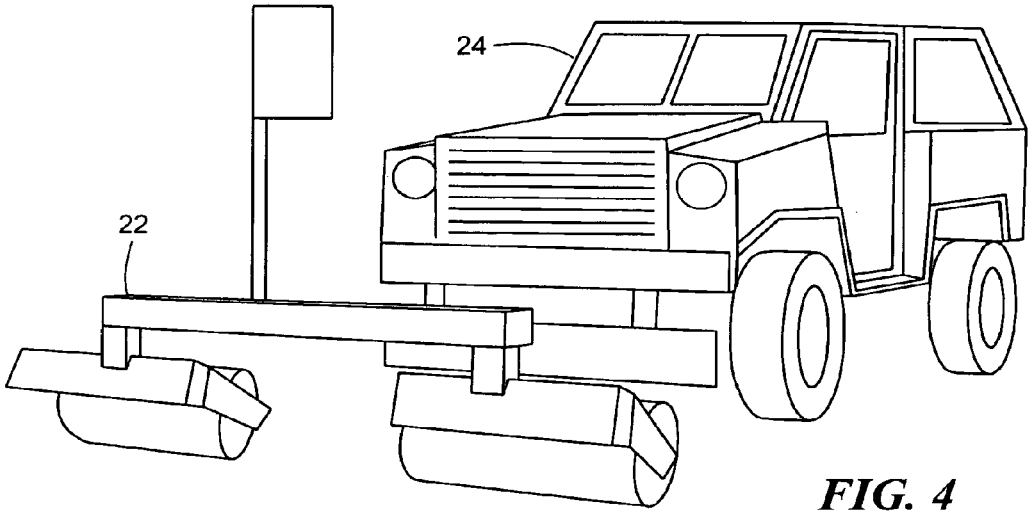
*FIG. 4*
PRIOR ART

GROUND PRESSURE DETONATION DEVICE

RELATED APPLICATIONS

This application claims benefit of and priority to U.S. Provisional Application Ser. No. 61/628,258, filed Oct. 27, 2011, and U.S. Provisional Application Ser. No. 61/629,657, filed Nov. 22, 2011 under 35 U.S.C. §§119, 120, 363, 365, and 37 C.F.R. §1.55 and §1.78 and both are incorporated herein by this reference.

FIELD OF THE INVENTION

This invention relates to a ground pressure detonation device.

BACKGROUND OF THE INVENTION

Pressure sensitive explosive devices buried in or on the ground, such as land mines, ground surface Improvised Explosive Devices (IEDs) detonators, and the like, may be cleared by vehicles equipped with a mine flail. A typical mine flail includes a rotating drum adorned with metal chains. The chains impact the ground with substantial force as the drum spins, causing land mines to detonate. Mine flails may have many sizes, e.g., from large tank-mounted devices to smaller devices attached to robots. However, conventional small, robot-mounted devices may have difficulty generating enough force to guarantee mine detonation.

Another conventional approach to clearing and/or detonating the pressure sensitive explosive devices described above may be to use heavy ground rollers. As the name implies, these devices typically include of one or more rolling mass (es) which impart a ground pressure as they are moved across terrain of interest for clearing. The ground pressures from the rollers are designed to be sufficiently high so as to detonate the mines, IEDs, detonators and similar devices in the path. However, achieving sufficient pressures may be difficult and may often require extremely massive roller systems.

BRIEF SUMMARY OF THE INVENTION

In one aspect, a ground pressure detonation device is featured. The device includes a housing, a foot coupled to the housing, and an oscillation subsystem associated with the housing configured to oscillate the housing such that foot impacts the ground with sufficient oscillatory force sufficient to ensure detonation of one or more pressure sensitive explosive devices in and/or on the ground.

In one embodiment, oscillation subsystem may be configured to oscillate the housing such that the housing and the foot bounce up and down off the ground and the foot impacts the ground with the sufficient oscillatory force. The oscillation subsystem may include at least one moveable mass and a drive subsystem configured to oscillate the housing. The subsystem may include two wheels and the at least one moveable mass includes a mass attached to each of the two wheels. The drive system may include a motor coupled to the two wheels configured to rotate the two wheels in a counter-rotating direction with respect to each other such that the masses on each of the two rotating wheels oscillate the housing. The device may include a spring between the foot and the housing configured to store energy to the oscillation subsystem when the housing contacts the foot and the foot contacts the ground and configured to return energy to the oscillation subsystem as the foot and the housing bounce away from the ground. The spring and/or the drive subsystem may be configured to tune the amount of the oscillating force and/or the amount of the bounce. The spring and/or the drive subsystem may be configured to create a resonant condition that transfers energy into the oscillating force. The frame may be configured as a cylinder and the at least one moveable mass is in the cylinder. The drive subsystem may include a detonation subsystem configured to create repeated explosions in the cylinder to drive the mass in a downward vertical direction. The device may include a spring in the cylinder configured to drive the mass in an upward vertical direction. The downward vertical direction and the upward vertical direction of the mass may create the oscillating force. At least one moveable mass may be in the housing and the drive system may be configured to move the mass in a downward vertical direction and an upward vertical direction to create the oscillating force. The drive system may include a voice coil actuator subsystem configured to move the mass in a downward vertical direction and a spring configured to move the mass in an upward vertical direction to create the oscillating force. The drive subsystem may include a crank and a connecting rod coupled to the at least one mass configured to move the mass in a downward vertical direction and an upward vertical direction to create the oscillating force. The oscillation subsystem may include a plurality of arms extending from the housing each having masses coupled thereto and a drive system for moving the arms and masses to create the oscillating force. The drive system may include a motor coupled to the a ns. The oscillation subsystem may include torsional springs coupled to the arms configured to control the motion of the arms. The device may include a spring between the foot and the housing configured to store energy to the oscillation subsystem when the housing contacts the foot and the foot contacts the ground and configured to return energy to the oscillation subsystem as the foot and the housing bounce away from the ground. The spring and/or the drive subsystem may be configured to tune the amount of the oscillating force and/or the amount of the bounce. The spring and/or the drive subsystem may be configured to create a resonant condition that transfers energy into the oscillating force. The drive system may include a flexure extending through the housing configured to form said arms and a motor configured to drive a cam in contact with the flexure to deflect the flexure and drive the arms to create the oscillating force. The housing may include an upward port and a downward port and the drive system includes a jet engine and a spinning plate in the housing configured to alternately direct thrust to the upward port and the downward port to oscillate the housing to create the oscillating. The device may include a spring between the foot and the housing configured to store energy to the oscillation subsystem when the housing contacts the foot and the foot contacts the ground and configured to return energy to the oscillation subsystem as the foot and the housing bounce away from the ground. The spring and/or the drive subsystem may be configured to tune the amount of the oscillating force and/or the amount of the bounce. The spring and/or the drive subsystem may be configured to create a resonant condition that transfers energy into the oscillating force. The housing may be tilted in a predetermined direction such that the ground pressure device bounces in a desired direction. The housing may be titled in a predetermined direction such that the ground pressure device bounces over one or more obstacles.

In another aspect, a ground pressure detonation device is featured. The device includes at least one mass, a foot coupled to the mass, a spring coupled between the foot and the mass, and a drive subsystem configured to repeatedly move the mass in a downward vertical direction. The spring is configured to drive the mass in an upward vertical direction. The downward vertical direction and the upward vertical direction of the mass causes the mass to oscillate such that the foot impacts the ground with sufficient oscillating force to ensure detonation of one or more pressure sensitive explosive devices in and/or on the ground.

In one embodiment, the mass and the spring may be configured to oscillate the mass such that the mass and the foot bounce up and down off the ground and the foot impacts the ground with the sufficient oscillatory force. The spring and the mass may be configured to tune the amount of the oscillating force and/or the amount of the bounce. The spring and the mass may be configured to create a resonant condition that transfers energy into the oscillating force. The mass may be tilted in a predetermined direction such that the ground pressure device bounces in a desired direction. The mass may be titled in a predetermined direction such that the ground pressure device bounces over one or more obstacles.

In yet another aspect, a ground pressure detonation device is featured. The device includes at least one mass and a drive system configured to repeatedly drive the mass in a downward vertical direction such that the mass impacts the ground with sufficient oscillating force to ensure detonation of at least one pressure sensitive explosive device in and/or on the ground.

In one embodiment, the mass may be tilted in a predetermined direction such that the ground pressure device bounces in a desired direction. The mass may be titled in a predetermined direction such that the ground pressure device bounces over one or more obstacles.

BRIEF DESCRIPTION OF THE SEVERAL VIEWS OF THE DRAWINGS

Other objects, features and advantages will occur to those skilled in the art from the following description of a preferred embodiment and the accompanying drawings, in which:

FIG. 3 is a photograph showing an example of a conventional roller mounted to a truck;

FIG. 4 is a photograph showing an example of a conventional roller mounted to a small vehicle;

DETAILED DESCRIPTION OF THE INVENTION

Figure 1:
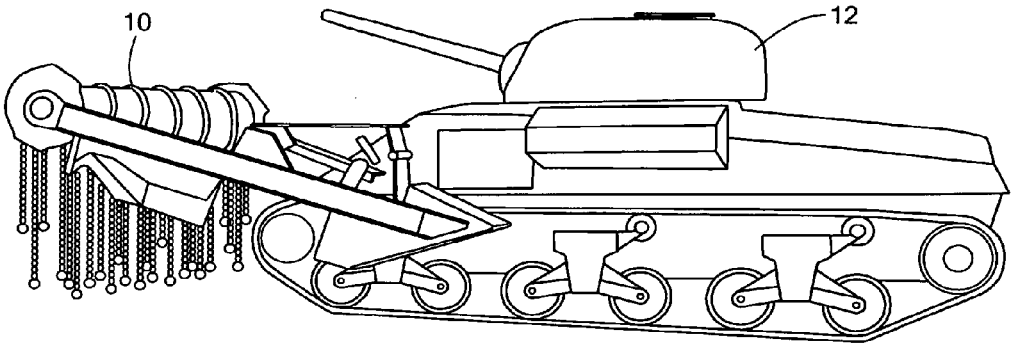
FIG. 1 PRIOR ART
FIG. 1 is a photograph showing an example of a conventional tank-mounted flail.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
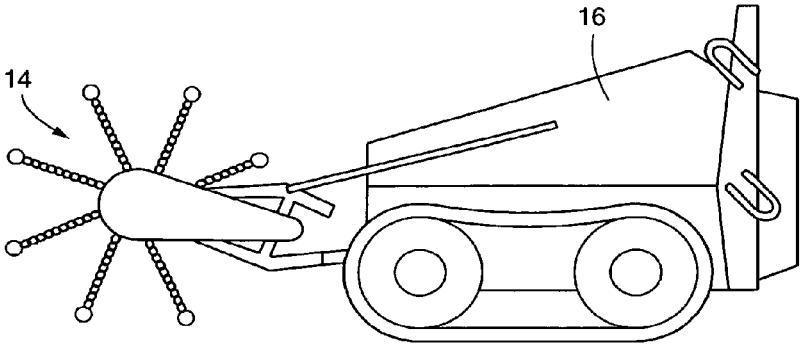
FIG. 2 PRIOR ART
FIG. 2 is a photograph showing an example of a conventional robot-mounted mine flail.

As discussed in the Background section above, pressure sensitive explosive devices buried in the ground are typically cleared by vehicles equipped with a mine flail or a mine roller. A mine flail typically includes a rotating drum adorned with metal chains. The chains impact the ground with substantial force as the drum spins, causing land mines to detonate. Mine flails come in many sizes, from large tank-mounted devices to small devices attached to robots. FIG. 1 shows an example of conventional mine flail 10 attached to tank 12. FIG. 2 shows an example of flail 14 attached to robot 16. However, there may be problems with conventional mine flail technology. The large size of the flail makes them unsuitable for clearing narrow paths that are not large enough for vehicles to traverse. The flails are not man-portable which may limit the locations at which mine clearance can be performed. Small mine flails may have problems generating enough force to trigger some mines.

Another approach to detonating pressure sensitive explosives buried in or on the ground is conventional rollers. Like flails, rollers can be mounted in front of tanks, trucks, or similar armored vehicles. Smaller rollers can be used with Bobcats, small tractors, robots, and the like, to attempt to detonate the pressure sensitive explosives. FIG. 3 shows an example of conventional roller 18 mounted to truck 20. FIG. 4 shows an example of conventional roller 22 to smaller vehicle 24.

Rollers may have the same shortcomings of flails discussed above. Similarly, small rollers may have problems generating sufficient force to trigger some pressure sensitive explosives.

The ground pressure detonation device of one or more embodiments of this invention overcomes the problems associated with conventional flails and rollers discussed above by providing a small, man-portable device that provides sufficient force needed to detonate pressure sensitive explosive devices in or on the ground.

Figure 5:
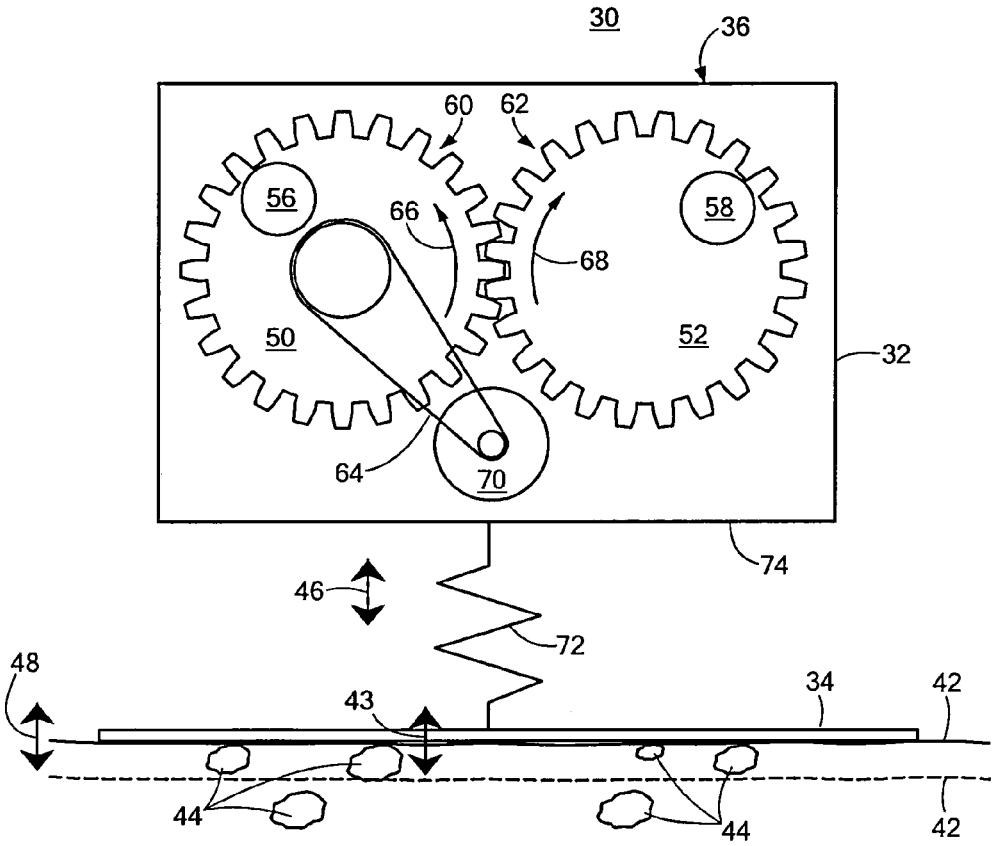
FIG. 5 is a schematic front-view of one embodiment of the ground pressure detonation device of this invention.

Ground pressure detonation device 30, FIG. 5, of one embodiment of this invention includes housing 32 and foot 34 coupled to housing 32. Ground pressure detonation device 30 also includes oscillation subsystem 36 associated with housing 32 configured to oscillate housing 32, e.g., in the direction indicated by arrow 46, such that foot 34 impacts ground 42 with sufficient oscillatory force 43 to ensure detonation of one or more pressure sensitive explosive devices 44 in and/or on the ground 42. In one example, housing 32 oscillates in direction 46 and foot 34 remains stationary on ground 42. In this example, housing 32 contacts foot 34 which impacts ground 42 with oscillatory force 43. In another example, foot 34 and housing 32 may bounce up and down off ground 42 (shown in phantom), indicated by arrow 48, and impact ground 42 with sufficient oscillatory force 43. When device 30 bounces up and down off ground 42, device 30 can be advanced in a desired direction while preferably "hopping" over obstacles, such as tree roots, stones, debris, and the like.

In the example shown, oscillation subsystem 36 includes two counter-rotating wheels 50, 52 with masses 56, 58 attached thereto. Motor 70 may be used with belt 64 linking motor 70 to drive one of wheels 50, 52, e.g., wheel 50 to rotate wheels 50, 52 in a counter rotating manner with respect to each other, e.g., as shown by arrows 66, 68. Motor 70 may be a brushed DC motor, an air motor, a brushless DC motor, an induction motor, an internal combustion motor, or similar type motor. The rotation of wheels 50, 52 with masses 56, 58 is preferably slaved together using gears 60, 62, a timing belt, and linkages or controls (not shown). As wheels 50, 52 counter-rotate, the lateral portion of the centrifugal force balances out, creating net oscillating vertical motion 46 of housing 32 that causes foot 34 to impact ground 42 with sufficient oscillatory force 43 to ensure detonation of one or more pressure sensitive explosive devices 44 in and/or on the ground 42.

The result is ground pressure detonation device 30 effectively and efficiently detonates pressure sensitive devices in and/or on the ground. Device 30 is a small, man-portable device and overcomes the problems associated with conventional flails and rollers discussed above.

In one design, device 30 may include spring 72 attached to bottom 74 of housing 32 and foot 34. Spring 72 stores energy to oscillation subsystem 36 when housing 32 contacts foot 34 which impacts ground 42 and returns energy to oscillation subsystem 36 as device 30 bounces away from ground 42 saving drive power. The oscillatory force of foot 34 on ground 42 and the amount of bounce of foot 34 and housing 32 on and off ground 42 can be tailored by selection of the stiffness of spring 72 and/or the rotation rate of wheels 50, 52. Additionally, spring 72 and/or the amount of rotation of wheels 50, 52 may be used to create a resonant condition of housing 32 and/or foot 34 which efficiently transfers the input energy into oscillatory force 43 that impacts ground 42.

Figure 6:
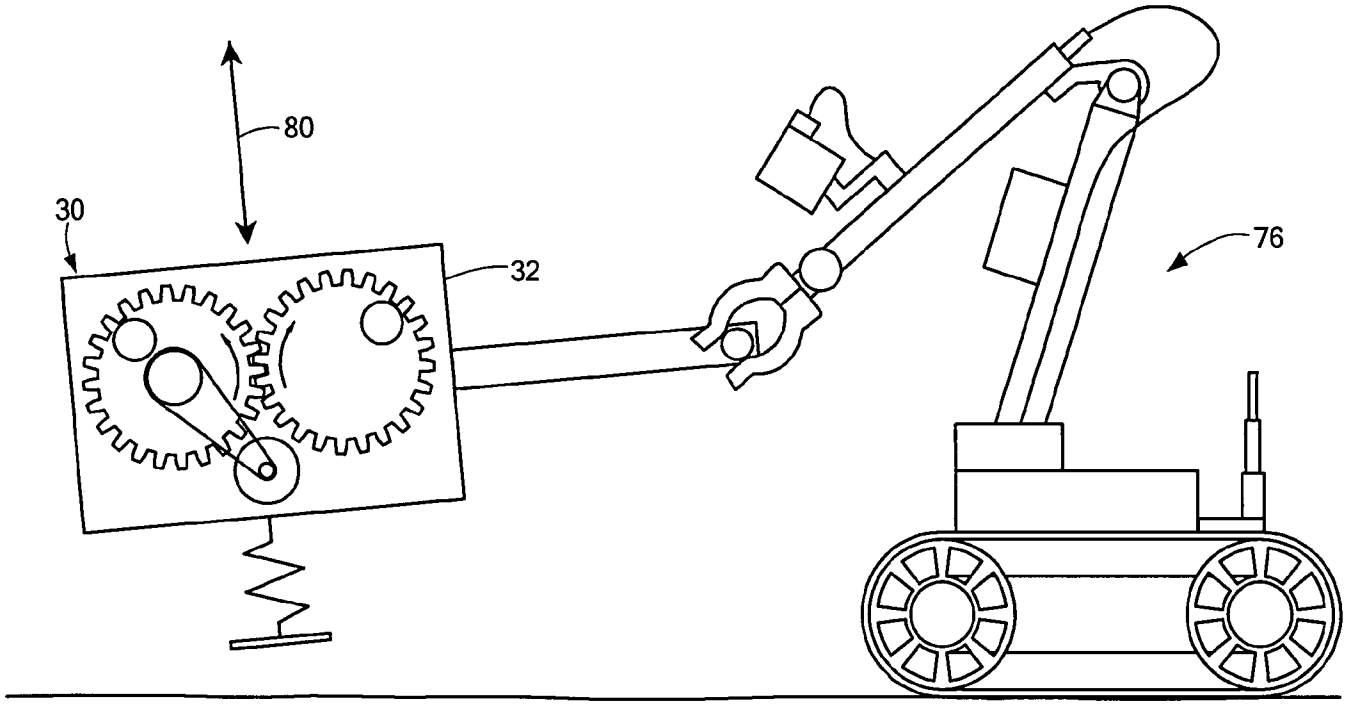
FIG. 6 is a view showing one example of the operation of the ground pressure detonation device of this invention.

In one exemplary operation, the ground pressure detonation device 30, FIG. 6, of one embodiment of this invention may be attached to a small robot, e.g. small robot 76. By raising or lowering the attachment point to the robot to housing 32 of device 30, line of action 80 can be changed slightly from a strictly vertical orientation, causing device 30 to travel in a desired direction, e.g., hop backwards or forwards. The change in line of action 80 essentially makes device 30 self-propelling.

Figure 7:
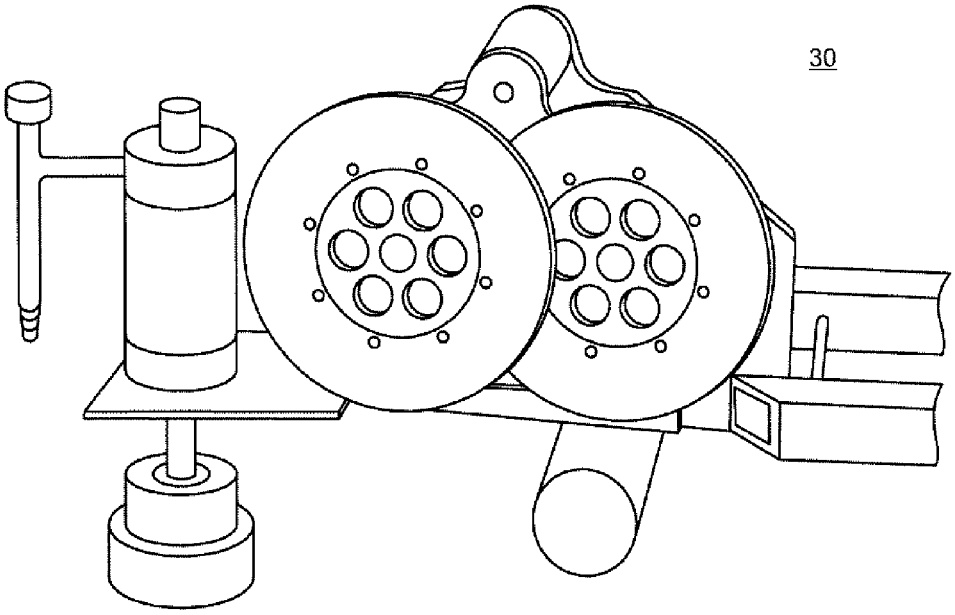
FIG. 7 is a photograph of a proof-of-concept prototype of one embodiment of the ground pressure detonation device of this invention.

A photograph of one example of a proof-of-concept prototype ground pressure detonation device 30 is shown in FIG. 7. In this example, the proof-of-concept device weighs approximately 27 lbs. In operation, the oscillatory force of device 30, FIGS. 5-15, on ground 42 may exceed 600 lbf.

Figure 8:
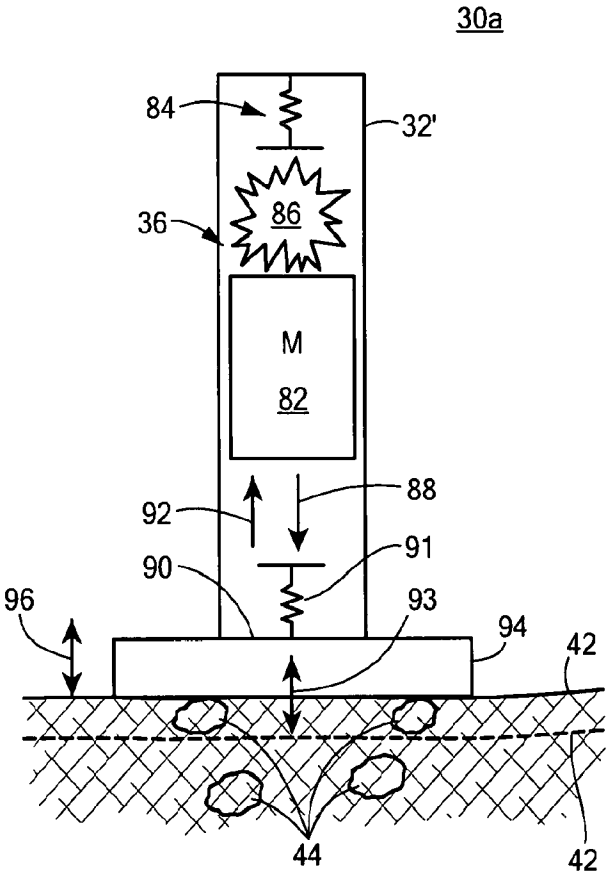
FIG. 8 is a schematic front-view of another embodiment of the ground pressure detonation device of this invention.

Ground pressure detonation device 30*a*, FIG. 8, where like parts have been given like numbers, of another embodiment of this invention preferably includes housing 32' configured as a cylinder as shown with moveable mass 82 therein. The cylinder may be similar to a cylinder of an internal combustion engine or similar type device. In this example, oscillation subsystem 36 includes detonation subsystem 84 configured to create small repeated explosions, e.g., gas explosion 86, which drive mass 82 in downward vertical direction 88. Mass 82 impacts bottom 90 of housing 32' and bounces in upward vertical direction 92. Device 30 may included spring 91 configured to tune the response of mass 82 with bottom 90 of the housing 32. The downward and upward movement of mass 82 in housing 32' oscillates housing 32' and foot 94, preferably in net oscillating vertical motion 96, such that foot 94 impacts ground 42 with sufficient oscillatory force 93 to ensure detonation of one or more pressure sensitive explosive devices 44 in and/or on the ground 42. Preferably, the downward and upward movement of mass 82 in housing 32' to create a resonant condition of housing 32' and foot 94 which efficiently transfers the input energy into oscillatory force 93 that impacts ground 42. When device 30*a* bounces up and down off ground 42, device 30*a* can be advanced in a desired direction while preferably "hopping" over obstacles, such as tree roots, stones, debris, and the like. Device 30*a* may also include an additional spring 72, FIG. 5, and an additional foot 34 that may operate in a similar manner as device 30.

Figure 9:
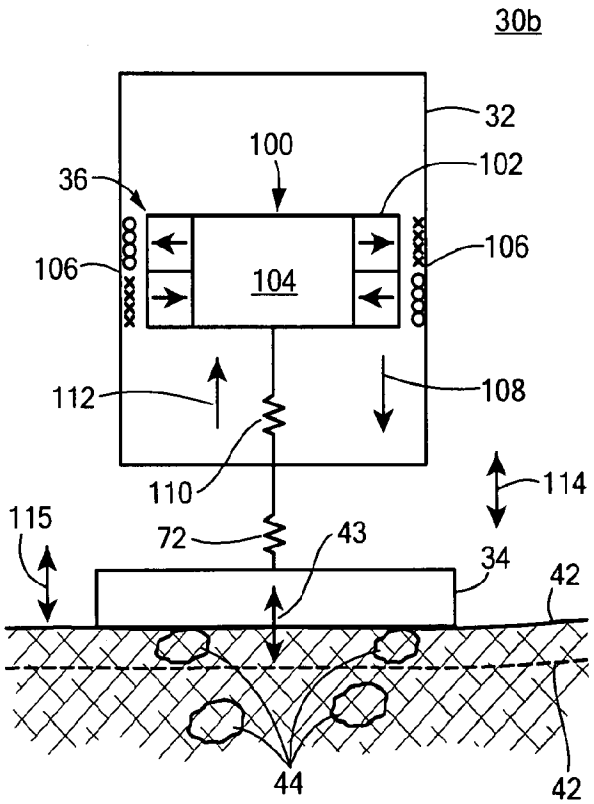
FIG. 9 is a schematic front-view of another embodiment of the ground pressure detonation device of this invention.

Ground pressure detonation device 30*b*, FIG. 9, where like parts have been given like numbers, of another embodiment of this invention is similar to device 30, FIG. 5, except, in this example, oscillation subsystem 36 is configured as voice coil actuator 100. Voice coil actuator 100 may be any known voice coil actuator known by those skilled. In one example, voice coil actuator 100 includes magnets 102 coupled to moveable mass 104 and stationary coils 106 affixed to housing 32. Voice coil actuator 100 is preferably configured to drive mass 104 in downward vertical direction 108. Spring 110 coupled to mass 104 and housing 32 drives mass 104 in upward vertical direction 112. The downward vertical and upward vertical movement of mass 104 inside housing 32 oscillates housing 32, preferably in net oscillating vertical motion 114, such that foot 34 impacts ground 42 with sufficient oscillatory force 43 to ensure detonation of one or more pressure sensitive explosive devices 44 in and/or on the ground 42. In one example, housing 32 oscillates in direction 114 and foot 34 remains stationary on ground 32. In this example, housing 32 contacts foot 34 which impacts ground 42 with sufficient oscillatory force 43. In another example, foot 34 and housing 32 may bounce up and down off ground 42 (shown in phantom), indicated by arrow 115, and foot 34 impacts ground 42 with sufficient oscillatory force 43. When device 30*b* bounces on and off ground 42, device 30*b* can be advanced in a desired direction while preferably "hopping" over obstacles, such as tree roots, stones, debris, and the like. Similar to device 30, FIG. 5, device 30*b*, may include spring 72 in a similar manner. The oscillatory force of foot 34, FIG. 9, on ground 42 and the amount bounce of foot 34 and housing 32 up and down from ground 42 may be tailored by selection of the stiffness of spring 72 and/or spring 110 and/or the amount of linear motion provided by voice coil actuator 110. Additionally, spring 72 and/or spring 110 and/or voice coil actuator 100 may be used to create a resonant condition of device 30*b* which efficiently transfers the input energy into oscillatory force 43 that impacts ground 42.

Figure 10:
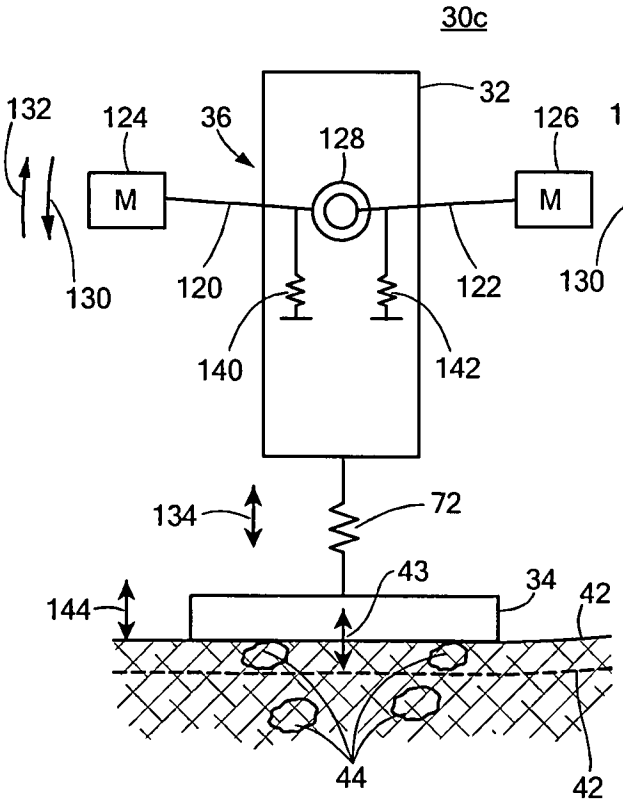
FIG. 10 is a schematic front-view of another embodiment of the ground pressure detonation device of this invention.

Ground pressure detonation device 30*c*, FIG. 10, where like parts have been given like numbers, of another embodiment of this invention preferably includes oscillation subsystem 36 that includes arms 120 and 122 that extend from housing 32 with masses 124 and 126 attached thereto, respectively. Motor 128 is preferably coupled to aims 120, 122 and drives arms 120, 122 with masses 124, 126 in downward vertical direction 130 and upward vertical direction 132 to oscillate housing 32, preferably in net oscillating vertical motion 134, such that foot 34 impacts ground 42 with sufficient oscillatory force 43 to ensure detonation of one or more pressure sensitive explosive devices 44 in and/or on the ground 42. In one example, housing 32 oscillates in direction 134 and foot 34 remains stationary on ground 32. In this example, housing 32 contacts foot 34 which impacts ground 42 with sufficient oscillatory force 43. In another example, foot and housing 32 may bounce up and down off ground 42 (shown in phantom), indicated by arrow 144, and impact ground 42 with sufficient oscillatory force 43. When device 30*c* bounces up and down off ground 42, device 30*c* can be advanced in a desired direction preferably while "hopping" over obstacles, such as tree roots, stones, debris, and the like.

Device 30*c* also preferably includes torsional springs 140 and 142 coupled to arms 120 and 124, respectively, which may limit the motion of arms 120, 122. Motor 128 preferably drives arms 120, 122 by moving through small displacements instead of a full rotation. Preferably, motor 128 is driven with an oscillating voltage/torque to bring device 30*c* into resonance.

Device 30*c* may include spring 72 that functions similar as discussed above. The oscillatory force of foot 34 on ground 34 and the amount of bounce of foot 34 and housing 34 on and off ground 42 as can be tailored by selection of the stiffness of spring 72 and/or springs 140, 142 and/or the rate of motor 128. Additionally, spring 72 and/or springs 140, 142 and/or arms 120, 122 may be used to create a resonant condition of housing 32 and foot 34 which efficiently transfers the input energy into oscillatory force 43 that impacts ground 42.

Figure 11:
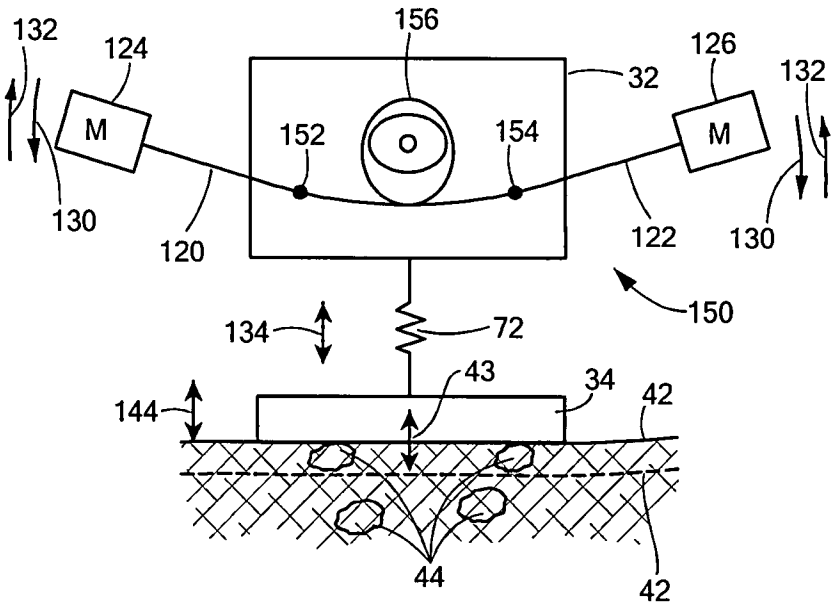
FIG. 11 is a schematic front-view of another embodiment of the ground pressure detonation device of this invention.

Ground pressure detonation device 30*d*, FIG. 11, where like parts have been given like numbers, of yet another embodiment of this invention, is similar to ground pressure detonation device 30*c*, FIG. 10, except, in this example, detonation device 30*d*, FIG. 11, includes single flexure 150 that forms arms 120, 122 with masses 124 and 126 attached thereto. Flexure 150 is preferably pinned at points 152 and 154. A rotating motor (not shown) attached to cam 156 causes flexure 150 to deflect as it spins to drive masses 124 and 126 in downward vertical direction 130 and upward vertical direction 132 to oscillate housing 32, preferably in net oscillating vertical motion 134, and in the correct phase, preferably bringing system 30*d* into resonance, such that foot 34 impacts ground 42 with sufficient oscillatory force 43 to ensure detonation of one or more pressure sensitive explosive devices 44 in and/or on the ground 42.

Figure 12:
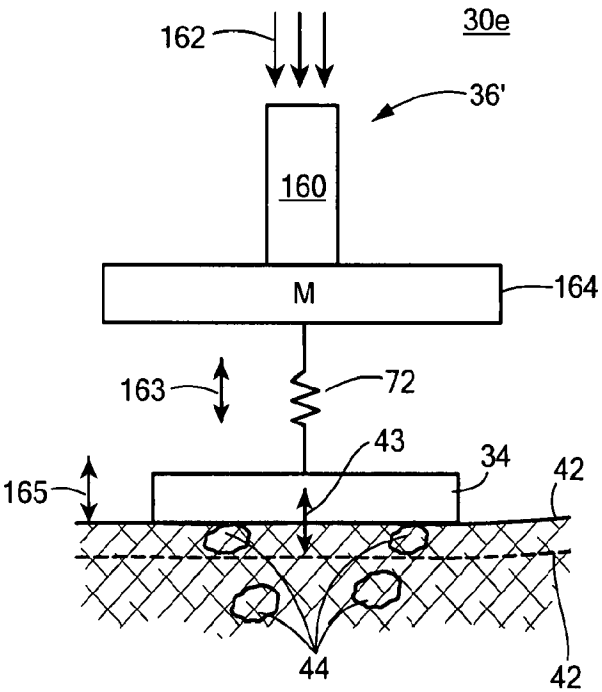
FIG. 12 is a schematic front-view of another embodiment of the ground pressure detonation device of this invention.

Ground pressure detonation device 30*e*, FIG. 12, where like parts have been given like numbers, of another embodiment of this invention preferably includes oscillation subsystem 36' configured as pulse jet 160 configured to apply a sequence of pulses 162 towards mass 164. Pulses 162 cause mass 164 to travel in downward vertical direction such that mass foot 34 impacts ground 42 with sufficient oscillatory force 43 to ensure detonation of one or more pressure sensitive explosive devices 44 in and/or on the ground 42. In one example, housing 32 oscillates in direction 163 and foot 34 remains stationary on ground 42. In this example, mass 164 contacts foot 34 which impacts ground 42 with sufficient oscillatory force 43. In another example, mass 164 and foot 34 may bounce up and down off ground 42 (shown in phantom), indicated by arrow 165, and foot 34 impacts ground 42 with sufficient oscillatory force 43. When device 30*e* bounces up and down off ground 42, device 30*e* can be advanced in a desired direction preferably while "hopping" over obstacles, such as tree roots, stones, debris, and the like.

Device 30*e* may include spring 72 that functions similar as discussed above. The oscillatory force of foot 34 on ground 42 and mass 162 and foot 34 as they bounce up and down off ground 42 can be tailored by selection of the stiffness of spring 72 and/or the amount of force provided by pulses 162. Additionally, spring 72 and/or the amount of force provided by pulses 162 may be used to create a resonant condition of device 30*e* which efficiently transfers the input energy into oscillatory force 43 that impacts ground 42.

Figure 13:
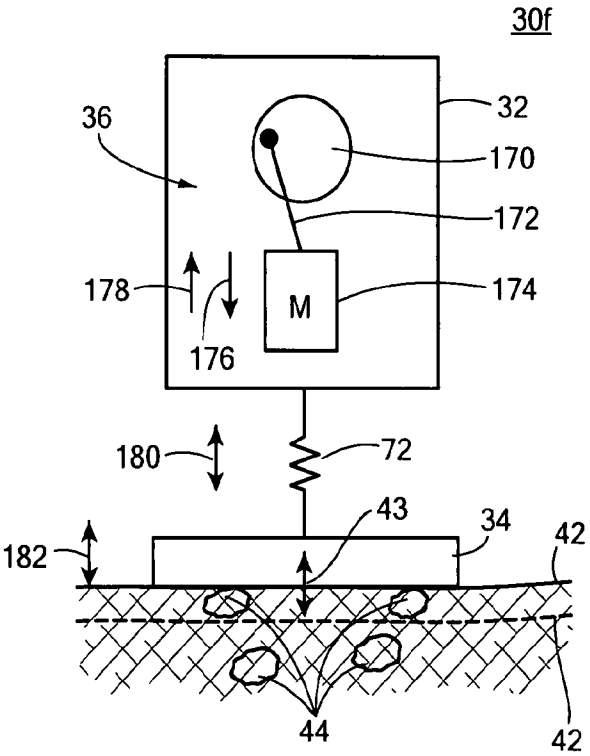
FIG. 13 is a schematic front-view of another embodiment of the ground pressure detonation device of this invention.

Ground pressure detonation device 30*f*, FIG. 13, where like parts have been given like numbers, of another embodiment of this invention is similar to device 30, FIG. 5, except, in this example, oscillation subsystem 36 is configured as crank 170 and connecting rod 172 coupled to mass 174. A motor (not shown) drives crank 170 causing mass 174 to move in downward vertical direction 176 and upward vertical direction 178 to oscillate housing 32, preferably in net oscillating vertical motion 180, such that foot 34 impacts ground 42 with sufficient oscillatory force 43 to ensure detonation of one or more pressure sensitive explosive devices 44 in and/or on the ground 42. In one example, housing 32 oscillates in direction 180 and foot 34 remains stationary on ground 42. In this example, housing 32 contacts foot 34 which impacts ground 42 with sufficient oscillatory force 43. In another example, foot and housing 32 may bounce up and down off ground 42 (shown in phantom), indicated by arrow 182, and foot 34 impact ground 42 with sufficient oscillatory force 43. When device 30*d* bounces up and down off ground 42, device 30*d* can be advanced in a desired direction preferably while "hopping" over obstacles, such as tree roots, stones, debris, and the like.

Device 30*f* may include spring 72 that functions similar as discussed above. The oscillatory force of foot 34, FIG. 13, on ground 42 and housing 32 and foot 34 as they bounce up and down off ground 42 can be tailored by selection of the stiffness of spring 182 and/or the rate of rotation of crank 170. Additionally, spring 72 and/or the rotation of crank 170 may be used to create a resonant condition of device 30*f* which efficiently transfer the input energy into oscillatory force 43 that impacts ground 42.

Figure 14:
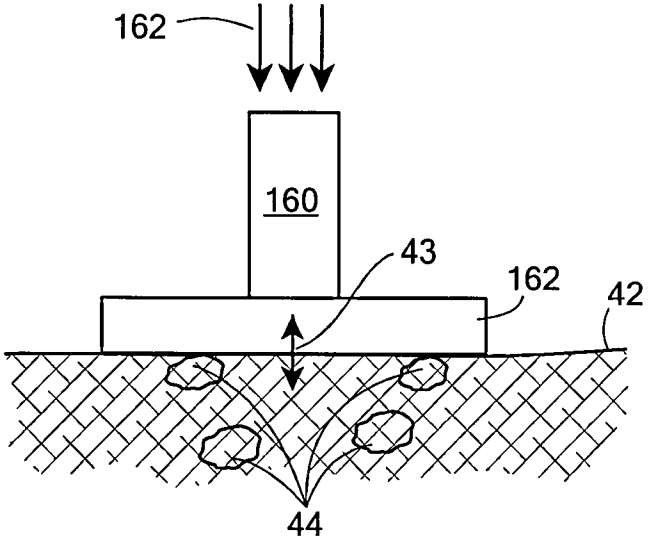
FIG. 14 is a schematic front-view of another embodiment of the ground pressure detonation device of this invention.

Ground pressure detonation device 30*g*, FIG. 14, where like parts have been like numbers, of another embodiment of this invention is similar to ground pressure detonation device 30*e*, FIG. 12. However, in this example, ground pressure detonation device 30*g*, FIG. 14, may use a thrust 162 from pulse jet 160 that is high enough so that resonance may not be needed to save energy from one cycle to the next. Device 30*g* is preferably made such that mass 162 directly impacts ground 42 with sufficient force to ensure detonation of pressure sensitive explosive devices 44 in and/or on ground 42.

Figure 15:
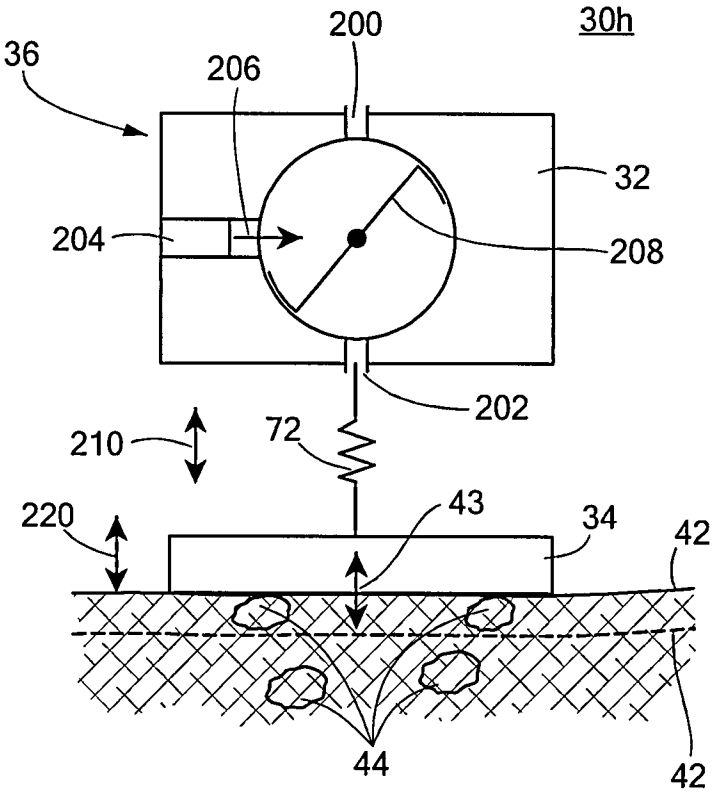
FIG. 15 is a schematic front-view of another embodiment of the ground pressure detonation device of this invention.

Ground pressure detonation device 30*h*, FIG. 15, where like parts have been given like numbers of another embodiment of this invention preferably includes housing 32 that includes port 200 located on the top of housing 32 and port 202 located on the bottom of housing 32 as shown. In this example, oscillation subsystem 36 is configured as jet engine 204 configured to provide continuous thrust 206. In other designs, thrust 206 may be supplied from a cylinder having compressed gas therein. Device 30*h* also preferably includes spinning plate 208, or similar type device vectoring device, which directs thrust 206 so it is alternately directed down through port 202 and up through port 200 to oscillate housing 32, preferably in net oscillating vertical motion 210, such that foot 34 impacts ground 42 with sufficient oscillatory force 43 to ensure detonation of one or more pressure sensitive explosive devices 44 in and/or on the ground 42. In one example, housing 32 oscillates in direction 210 and foot 34 remains stationary on ground 42. In this example, housing 32 contacts foot 34 which impacts ground 42 with sufficient oscillatory force 43. In another example, foot and housing 32 may bounce up and down off ground 42 (shown in phantom), indicated by arrow 220, and foot 34 impact ground 42 with sufficient oscillatory force 43. When device 30*h* bounces up and down off ground 42, device 30*h* can be easily advanced preferably while "hopping" over obstacles, such as tree roots, stones, debris, and the like.

Device 30*h* may also include spring 72 coupled to foot 34 as discussed above. The oscillatory force of foot 214 on ground 42 and housing 32 and foot 34 as they bounce on and off ground 42 can be tailored by selection of the stiffness of spring 212 and/or the amount of thrust 206 and/or the selection of ports 200 and 202. Additionally, spring 72 and the thrust from ports 200 and 202 may be used to create a resonant condition of device 30*h* which efficiently transfers the input energy into oscillatory force 43 that impacts ground 42.

The result is ground pressure detonation device 30 of one or more embodiments of this invention discussed above with reference to one or more of FIGS. 5-15 generates a large, oscillating, vertical force and creates a sufficient force via impact loading with the ground to ensure detonation of pressure sensitive explosive devices in or on the ground. An energy storage spring may create a resonant condition that minimizes power requirements. Device 30 is relatively small and light weight and is therefore manportable.

In addition to applications for narrow trails and areas where man portability of the device is desired, ground pressure detonation device 30 of one or more embodiments of this invention can be scaled to greater sizes and/or used in multiple numbers to replace the flails, rollers, and other devices that might be used on roadways and areas wider than small paths. In these applications, ground pressure detonation device 30 of one or more embodiments of this invention may offer very high ground forces and pressures while weighing far less than conventional flails or rollers that might be used in similar applications. The lower weight of the ground pressure detonation device may provide for easier transport and lower loads and stresses on the vehicles used for guiding and propelling the device.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. A ground pressure detonation device comprising:

a housing;

a foot coupled to the housing;

an oscillation subsystem associated with the housing configured to oscillate the housing such that the foot impacts the ground with oscillatory force sufficient to ensure detonation of one or more pressure sensitive explosive devices in and/or on the ground; and a spring between the housing and the foot, the spring of a selected stiffness configured to create a resonant condition that efficiently transfers input energy into the oscillatory force thereby minimizing power requirements and/or weight of said device.

2. The device of claim 1 in which the oscillation subsystem is configured to oscillate the housing such that the housing and the foot bounce up and down off the ground and the foot impacts the ground with the sufficient oscillatory force.

3. The device of claim 1 in which the oscillation subsystem includes at least one moveable mass and a drive subsystem configured to oscillate the housing.

4. The device of claim 3 in which the drive subsystem includes two wheels and the at least one moveable mass includes a mass attached to each of the two wheels.

5. The device of claim 4 in which the drive subsystem includes a motor coupled to the two wheels configured to rotate the two wheels in a counter-rotating direction with respect to each other such that the masses on each of the two rotating wheels oscillate the housing.

6. The device of claim 2, the spring between the foot and the housing configured to store energy to the oscillation subsystem when the housing contacts the foot and the foot contacts the ground and configured to return energy to the oscillation subsystem as the foot and the housing bounce away from the ground.

7. The device of claim 6 in which the spring and/or the drive subsystem is configured to tune the amount of the oscillating force and/or the amount of the bounce.

8. The device of claim 6 in which the a drive subsystem is configured to create the resonant condition that transfers energy into the oscillating force.

9. The device of claim 2 in which the housing is configured as a cylinder and the at least one moveable mass is in the cylinder.

10. The device of claim 9 in which a drive subsystem includes a detonation subsystem configured to create repeated explosions in the cylinder to drive the mass in a downward vertical direction.

11. The device of claim 10 further including a spring in the cylinder configured to drive the mass in an upward vertical direction.

12. The device of claim 11 in which the downward vertical direction and the upward vertical direction of the mass create the oscillating force.

13. The device of claim 2 in which the at least one moveable mass is in the housing and the drive system is configured to move the mass in a downward vertical direction and an upward vertical direction to create the oscillating force.

14. The device of claim 13 in which the drive system includes a voice coil actuator subsystem configured to move the mass in a downward vertical direction and a spring configured to move the mass in an upward vertical direction to create the oscillating force.

15. The device of claim 13 in which the drive subsystem includes a crank and a connecting rod coupled to the at least one mass configured to move the mass in a downward vertical direction and an upward vertical direction to create the oscillating force.

16. The device of claim 1 in which the oscillation subsystem includes arms extending from the housing each having masses coupled thereto and a drive system for moving the arms and masses to create the oscillating force.

17. The device of claim 16 in which the drive system includes a motor coupled to the arms.

18. The device of claim 16 in which the oscillation subsystem further includes torsional springs coupled to the arms configured to control the motion of the arms.

19. The device of claim 16 in which the spring between the foot and the housing is configured to store energy to the oscillation subsystem when the housing contacts the foot and the foot contacts the ground and configured to return energy to the oscillation subsystem as the foot and the housing bounce away from the ground.

20. The device of claim 19 in which the spring and/or the drive subsystem is configured to tune the amount of the oscillating force and/or the amount of the bounce.

21. The device of claim 16 in which the spring and/or the drive subsystem are configured to create the resonant condition that transfers energy into the oscillating force.

22. The device of claim 16 in which the drive system includes a flexure extending through the housing configured to form said arms and a motor configured to drive a cam in contact with the flexure to deflect the flexure and drive the arms to create the oscillating force.

23. The device of claim 2 in which the housing includes an upward port and a downward port and the drive system includes a jet engine and a spinning plate in the housing configured to alternately direct thrust to the upward port and the downward port to oscillate the housing to create the oscillating.

24. The device of claim 23 in which the spring between the foot and the housing is configured to store energy to the oscillation subsystem when the housing contacts the foot and the foot contacts the ground and configured to return energy to the oscillation subsystem as the foot and the housing bounce away from the ground.

25. The device of claim 24 in which the spring and/or the drive subsystem is configured to tune the amount of the oscillating force and/or the amount of the bounce.

26. The device of claim 24 in which the spring and/or the drive subsystem are configured to create the resonant condition that transfers energy into the oscillating force.

27. The device of claim 2 in which the housing is tilted in a predetermined direction such that the ground pressure device bounces in a desired direction.

28. The device of claim 2 in which the housing is tilted in a predetermined direction such that the ground pressure device bounces over one or more obstacles.

29. A ground pressure detonation device comprising:

a housing;

a foot stationary on the ground and coupled to the housing; and an oscillation subsystem associated with the housing configured to oscillate the housing such that the housing contacts the foot which impacts the ground with oscillatory force sufficient to ensure detonation of one or more pressure sensitive explosive devices in and/or on the ground.

* * * * *